US007843143B2

(12) United States Patent
Kang

(10) Patent No.: US 7,843,143 B2
(45) Date of Patent: Nov. 30, 2010

(54) APPARATUS FOR DRIVING LAMPS AND LIQUID CRYSTAL DISPLAY HAVING THE SAME

(75) Inventor: Moon Shik Kang, Seongnam (KR)

(73) Assignee: Samsung Electronics Co., Ltd. (KR)

( * ) Notice: Subject to any disclaimer, the term of this patent is extended or adjusted under 35 U.S.C. 154(b) by 269 days.

(21) Appl. No.: 11/485,103

(22) Filed: Jul. 12, 2006

(65) Prior Publication Data

US 2007/0159115 A1 Jul. 12, 2007

(30) Foreign Application Priority Data

Jan. 11, 2006 (KR) ..... 10-2006-0003235

(51) Int. Cl.
*H05B 41/16* (2006.01)
*H05B 41/24* (2006.01)

(52) U.S. Cl. ..... 315/278; 315/277

(58) Field of Classification Search ..... 315/282, 315/224, 274, 276, 169.1, 169.2, 169.3, 169.4, 315/277, 278, 279, 312, 156; 345/156, 204, 345/205

See application file for complete search history.

(56) References Cited

U.S. PATENT DOCUMENTS 6,515,427 B2 * 2/2003 Oura et al. ..... 315/141
6,534,934 B1 * 3/2003 Lin et al. ..... 315/312
6,717,372 B2 * 4/2004 Lin et al. ..... 315/282
6,781,325 B2 * 8/2004 Lee ..... 315/282
6,947,024 B2 * 9/2005 Lee et al. ..... 345/102
7,075,244 B2 * 7/2006 Kang et al. ..... 315/212
7,282,868 B2 * 10/2007 Ushijima et al. ..... 315/277
7,291,987 B2 * 11/2007 Chang et al. ..... 315/282
7,294,971 B2 * 11/2007 Jin ..... 315/177
2005/0093482 A1 * 5/2005 Ball ..... 315/277
2005/0093484 A1 * 5/2005 Ball ..... 315/291

* cited by examiner

*Primary Examiner*—Douglas W Owens
*Assistant Examiner*—Minh D A
(74) *Attorney, Agent, or Firm*—Cantor Colburn LLP

(57) ABSTRACT

An apparatus for driving lamps and a liquid crystal display having the same, wherein the uniformity of luminance among lamps is improved, includes a main transformer unit for supplying a driving voltage to the lamps, and a balance transformer unit for making a lamp current of each of the lamps uniform. The balance transformer unit has a plurality of coils wound on a single body, and the coils have the same turns ratio and share magnetic flux so that a constant uniform current can flow through each of the coils. Accordingly, a lamp current of each of the lamps connected to the respective coils of the balance transformer unit can be maintained to be constant, and thus, the luminance of the lamp can be maintained uniformly.

22 Claims, 8 Drawing Sheets

APPARATUS FOR DRIVING LAMPS AND LIQUID CRYSTAL DISPLAY HAVING THE SAME

This application claims priority to Korean Patent application No. 10-2006-0003235, filed on Jan. 11, 2006, and all the benefits accruing therefrom under 35 U.S.C. §119, the contents of which are herein incorporated by reference in its entirety.

BACKGROUND OF THE INVENTION

1. Field of the Invention

The present invention relates to an apparatus for driving lamps and a liquid crystal display having the same, and more particularly, to an apparatus for driving lamps and a liquid crystal display having the same, wherein the luminance of light can be maintained uniformly.

2. Description of the Related Art

Since a liquid crystal display ("LCD") is a passive device that cannot emit light by itself, the LCD includes a backlight disposed below a liquid crystal display panel to provide light thereto. Generally, desired characteristics for backlights include high luminance, high efficiency, uniformity of luminance, long life, thinness, light weight, low costs, and the like. A lamp with small thickness and high efficiency is required for backlights employed in notebook computers or small-sized appliances, and a lamp with high luminance and high uniformity of luminance is required for larger LCDs such as for monitors or televisions ("TVs").

Backlights are classified as either edge type backlights or direct type backlights depending on the position of a light source. Among the types of backlights, a direct type backlight has been developed coinciding with an increase in the size of a liquid crystal display. This direct type backlight has a plurality of lamps arranged in a line below a liquid crystal display panel to irradiate an entire surface of the liquid crystal display panel with light. In the case of the direct type backlight, it is possible to secure high luminance by using the plurality of lamps.

However, as the size of a liquid crystal display increases, the number of lamps used in a backlight also increases. This results in many problems including the problem of maintaining uniform luminance among a plurality of lamps.

BRIEF SUMMARY OF THE INVENTION

The present invention is conceived to solve the aforementioned problems. Exemplary embodiments of the present invention provide an apparatus for driving lamps and a liquid crystal display having the same, wherein uniform luminance can be maintained by supplying the plurality of lamps with uniform electric power.

For example, the present invention provides an apparatus for driving lamps, comprising a first transformer unit for supplying a driving voltage to a plurality of lamps; and at least one second transformer unit connected to the plurality of lamps providing a same uniform lamp current to each of the lamps, wherein the second transformer unit comprises a body, and a plurality of coils wound on the body.

Each of the plurality of coils in the second transformer unit may have one end connected to the other end of each of the lamps, and the other end connected to a ground.

The apparatus may further comprise a third transformer unit for uniformly maintaining a current between at least two second transformer units. The third transformer unit may comprise at least two coils wound on a single body. Each of the plurality of coils of one of the at least two second transformer units may comprise a first end connected to a respective one end of each of some of the lamps, and a second other end connected to a first end of one of the coils in the third transformer unit; each of the plurality of coils of the other of the at least two second transformer units may comprise a first end connected to a respective one end of each of the other lamps, and a second other end connected to a first one end of the other coil in the third transformer unit; and other second end of the coils of the third transformer unit may be connected to a ground.

The apparatus may further comprise at least two second transformer units. Preferably, one coil of one of the second transformer units is electrically connected to one coil of the other of the second transformer units.

The plurality of coils of the second transformer unit may share magnetic flux. The plurality of coils preferably have the same turns ratio. The number of the coils preferably is three to five. The body may be made of a conductive material, and may have a shape selected among a polygonal shape including a rectangular shape, a circular shape, an elliptical shape, a horseshoe shape, a rod shape, and a shape having one or more rods with coils wound thereon and at least one connection portion for connecting the rods to each other.

Here, the plurality of coils may be wound on the body in the same direction, or at least some of the coils are wound on the body in a different direction.

The first transformer unit may comprise a transformer including a primary coil and a secondary coil, the primary coil may be connected to an input power source, and the secondary coil may have one end connected to each of the lamps and the other end connected to a ground.

The first transformer unit may comprise a plurality of transformers each of which includes a primary coil and a secondary coil, the primary coil of each of the plurality of transformers may be connected to an input power source, and the secondary coil may have one end connected to one end of a different one of the plurality of lamps and the other end connected to a ground.

The present invention provides a liquid crystal display comprising a backlight unit for emitting light; and a liquid crystal display panel for displaying an image by means of the light, wherein the backlight unit comprises a lamp unit including a plurality of lamps; a first transformer unit for converting an input AC voltage and applying the converted voltage to the plurality of lamps; and at least one second transformer unit having a plurality of coils wound on a single body so as to make a lamp current of each of the plurality of lamps uniform.

The liquid crystal display may further comprise a rectifying unit for converting a general-purpose AC voltage to a DC voltage; a voltage converting unit for converting the level of the DC voltage supplied by the rectifying unit and applying the converted voltage to the liquid crystal display panel; and an inverter unit for converting the DC voltage supplied by the rectifying unit into an AC voltage and supplying the AC voltage to the first transformer unit.

The plurality of coils of the second transformer unit may share magnetic flux. The plurality of coils of the second transformer unit preferably have the same turns ratio. The body is preferably made of a conductive material, and has a shape selected among a polygonal shape including a rectangular shape, a circular shape, an elliptical shape, a horseshoe shape, a rod shape, and a shape having one or more rods with coils wound thereon and at least one connection portion for connecting the rods to each other.

Each of the plurality of coils in the second transformer unit may have one end connected to one end of each of the lamps, and the other end connected to a ground.

The liquid crystal display may further comprise a third transformer unit for uniformly maintaining a current between at least two second transformer units, the third transformer unit comprising at least two coils wound on a single body. The liquid crystal display may further comprise at least two second transformer units, wherein one coil of one of the second transformer units is electrically connected to one coil of the other of the second transformer units.

Each of the plurality of coils of one of the at least two second transformer units may comprise a first end connected to a respective one end of each of some of the lamps and a second end connected to a first end of one of the coils in the third transformer unit. Each of the plurality of coils of the other of the at least two second transformer units may comprise a first end connected to a respective one end of each of the other of the lamps and a second end may be connected to a first end of the other coil in the third transformer unit and seconds ends of the coils of the third transformer unit may be connected to a ground.

The first transformer unit may comprise a transformer including a primary coil and a secondary coil, the primary coil may be connected to an input power source, and the secondary coil may have one end connected to one end of each of the lamps and the other end connected to a ground.

The first transformer unit may comprise a plurality of transformers each of which includes a primary coil and a secondary coil, the primary coil of each of the plurality of transformers may be connected to an input power source, and the secondary coil may have one end connected to one end of a different one of the plurality of lamps and the other end connected to a ground.

BRIEF DESCRIPTION OF THE DRAWINGS

The above and other aspects, features and advantages of the present invention will become apparent from the following description of exemplary embodiments given in conjunction with the accompanying drawings, in which.

DETAILED DESCRIPTION OF THE INVENTION

Figure 1:
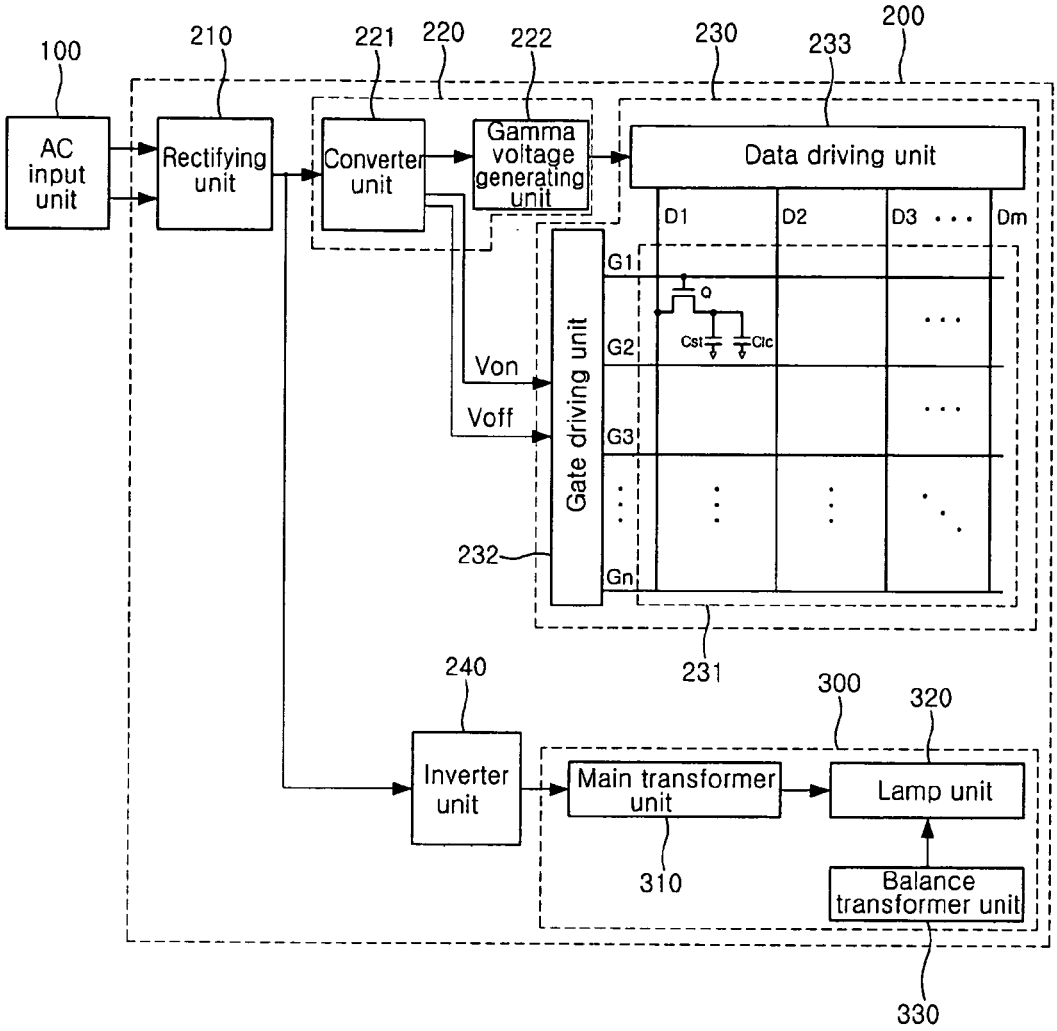
FIG. 1 is a conceptual block diagram illustrating an exemplary embodiment of a liquid crystal display according to the present invention.

Hereinafter, exemplary embodiments of the present invention will be described in detail with reference to the accompanying drawings. However, the present invention is not limited to the exemplary embodiments but may be implemented into different forms. These exemplary embodiments are provided only for illustrative purposes and for full understanding of the scope of the present invention by those skilled in the art. Throughout the drawings, like elements are designated by like reference numerals.

It will be understood that when an element or layer is referred to as being "on" or disposed "onto" another element or layer, the element or layer can be directly on another element or layer or intervening elements or layers. In contrast, when an element is referred to as being "directly on" or disposed "directly onto" another element or layer, there are no intervening elements or layers present. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "lower," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
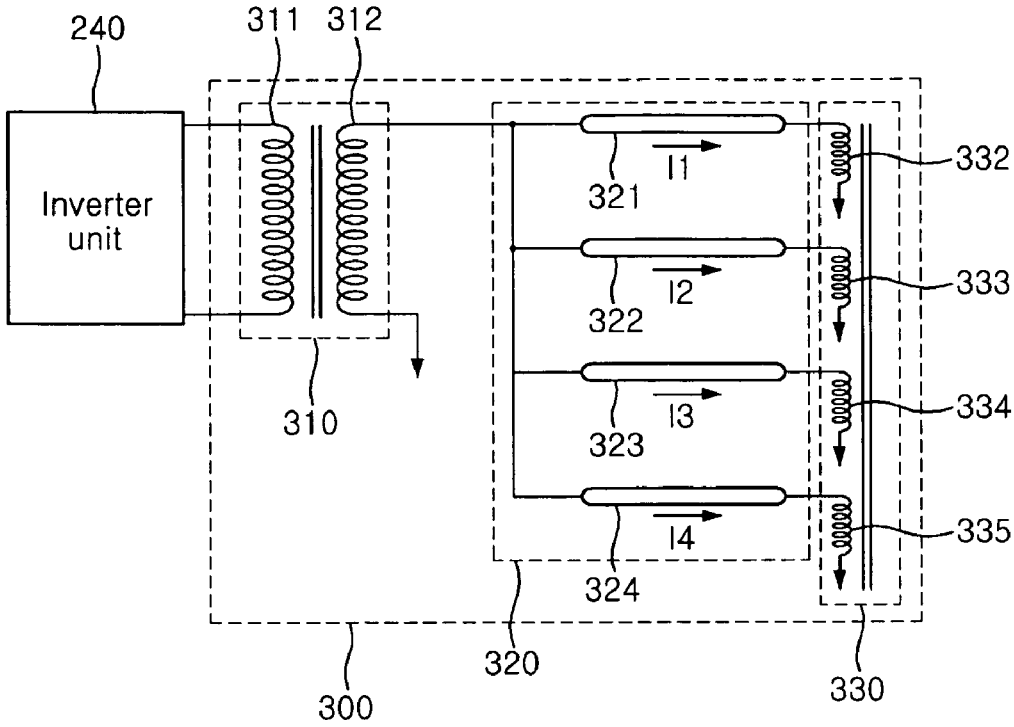
FIG. 2 is a circuit schematic diagram of an exemplary embodiment of a backlight unit according to the present invention.

FIG. 1 is a conceptual block diagram illustrating an exemplary embodiment of a liquid crystal display according to the present invention. FIG. 2 is a circuit schematic diagram of an exemplary embodiment of a backlight unit according to the present invention and FIG. 3 is a conceptual view illustrating a balance transformer unit of the backlight unit of FIG. 2.

Figure 3:
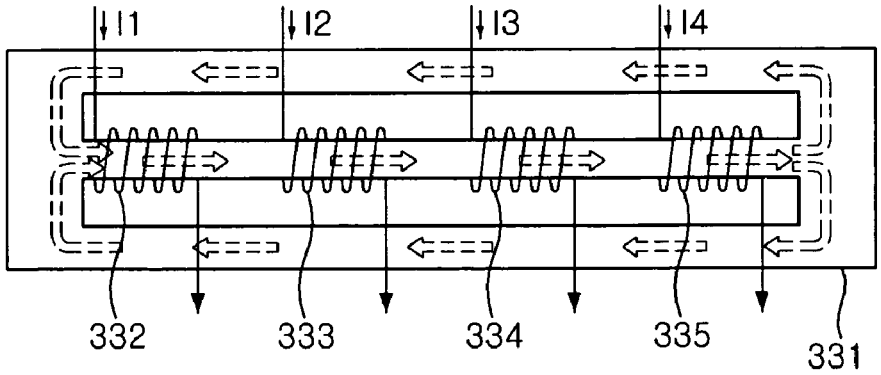
FIG. 3 is a conceptual view illustrating an exemplary embodiment of a balance transformer unit of the backlight unit of FIG. 2.

Referring to FIGS. 1 to 3, an exemplary embodiment of a liquid crystal display according to the present invention includes an AC input unit 100 and a liquid crystal display module unit 200.

The AC input unit 100 supplies a general-purpose AC voltage (e.g., 100V to 240V) to the liquid crystal display module unit 200. Preferably, the general-purpose AC voltage is applied to the liquid crystal display module unit 200 by plugging a given plug into a wall outlet.

The liquid crystal display module unit 200 comprises a rectifying unit 210, a voltage converting unit 220, a liquid crystal display panel unit 230, an inverter 240, and a backlight unit 300. The liquid crystal display module unit 200 is supplied with the general-purpose AC voltage from the AC input unit 100 and displays a predetermined image provided by an external graphic controller (not shown).

The rectifying unit 210 has a power factor correction ("PFC") function and converts the general-purpose AC voltage into a high DC voltage. The DC voltage is supplied to the voltage converting unit 220 and the inverter unit 240. Examples of the rectifying unit 210 include a diode rectifier or an active pulse width modulated ("PWM") rectifier.

The voltage converting unit 220 comprises a converter unit 221 for generating a gate ON voltage Von and a gate OFF voltage Voff from the DC voltage supplied by the rectifying unit 210, and a gamma voltage generating unit 222 for generating a gamma voltage from the voltage supplied by the converter unit 221. The converter unit 221 converts the high DC voltage (e.g., 500V to 600V) supplied by the rectifying unit 210 into a DC power voltage for use in driving the liquid crystal display panel unit 230 and the gamma voltage generating unit 222, and outputs the DC power voltage. In exemplary embodiments, the converter unit 221 is one of a boost converter, a buck converter, a half-bridge converter, a flyback converter, a full-bridge converter, a push-pull converter and a forward converter. In exemplary embodiments, the gamma voltage generating unit 222 generates the gamma voltage from the DC power voltage of which the level is converted by the converter unit 221. In this exemplary embodiment, the voltage converting unit 220 may further comprise a common electrode voltage generating unit (not shown) for generating a common electrode voltage Vcom from the DC power voltage of which the level is converted by the converter unit 221.

The liquid crystal display panel unit 230 comprises a liquid crystal display panel 231 with a plurality of pixels connected to gate lines G1 to Gn and data lines D1 to Dm and arranged generally in a matrix form, a gate driving unit 232 connected to the gate lines G1 to Gn, and a data driving unit 233 connected to the data lines D1 to Dm. Each of the pixels comprises a thin film transistor Q for transferring a data signal in response to a signal of a corresponding one of the gate lines G1 to Gn, a liquid crystal capacitor Clc and a sustaining capacitor Cst connected to the thin film transistor Q. The gate driving unit 232 and the data driving unit 233 transfer a gate signal to the gate lines G1 to Gn and a data signal to the data lines D1 to Dm, respectively, in response to voltages from the voltage converting unit 220. In this case, the gate driving unit 232 is supplied with the gate ON voltage Von and the gate OFF voltage Voff from the converter unit 221. The data driving unit 233 is supplied with the gamma voltage from the gamma voltage generating unit 222.

The inverter unit 240 converts the high DC voltage (e.g., 300V to 600V) generated by the rectifying unit 210 into an AC voltage suitable for the backlight. The inverter may be any inverter using high voltage. For example, the inverter may be a Royer inverter, a push-pull inverter, a half-bridge inverter, a full-bridge inverter or the like.

The backlight unit 300 comprises a main transformer unit 310 for converting the AC power voltage applied by the inverter unit 240 into a voltage with a corresponding amplitude based on a turns ratio of the main transformer unit 310, a lamp unit 320 operating with the voltage transformed by the main transformer unit 310, and a balance transformer unit 330 for uniformly maintaining the luminance of the lamp unit 320 by uniformly sustaining a current applied to the lamp unit 320.

The backlight unit 300 will be described with reference to FIGS. 2 and 3.

The main transformer unit 310 comprises a primary coil 311 and a secondary coil 312. In this case, the primary coil 311 has both ends connected to the inverter unit 240, and the secondary coil has one end connected to the lamp unit 320 and other end connected to a ground. At this time, when the primary coil 311 is supplied with the AC power voltage from the inverter unit 240, a current flows through the primary coil 311 such that a voltage with an amplitude determined by a turns ratio of the primary and secondary coils is induced into the secondary coil 312. For example, if the turns ratio of the primary coil 311 to the secondary coil 312 is 1:10 and the voltage applied to the primary coil 311 is 1V, the voltage induced into the secondary coil 312 becomes 10V. In this exemplary embodiment, the number of turns of the primary coil 311 is preferably smaller than that of the secondary coil 312. It will be recognized that the number of turns refers to the number of times a coil is wound.

The lamp unit 320 comprises a plurality of lamps 321, 322, 323 and 324, as described above. Preferably, the lamps are connected in parallel with one another and between the main transformer unit 310 and the balance transformer unit 330. Preferably, each of the lamps 312, 322, 323 and 324 has one end connected to the secondary coil 312 of the main transformer unit 310. As shown in FIG. 2, in this exemplary embodiment, the first to fourth lamps 321, 322, 323 and 324 are provided in the lamp unit 320 and one end of each of the lamps 321, 322, 323 and 324 is connected to the secondary coil 312 of the main transformer unit 310.

In exemplary embodiments as illustrated in FIG. 3, the balance transformer unit 330 is a transformer with a plurality of coils 332, 333, 334 and 335 wound on a single body 331. That is, the balance transformer unit 330 comprises a body 331 with a central shaft traversing the inside of a rectangular frame, and the first to fourth coils 332, 333, 334 and 335 wound multiple times on the central shaft of the body 331. Preferably, the body 331 is made of a conductive material. At this time, each of the first to fourth coils 332, 333, 334 and 335 has one end of the respective coil connected to the other end of a corresponding one of the first to fourth lamps 321, 322, 323 and 324, and the other end of the respective coil connected to a ground, as best seen with reference to FIG. 2. Preferably, the first to fourth coils 332, 333, 334 and 335 have the same number of turns, i.e., turns ratio. This ensures that currents I1, I2, I3 and I4 flowing through the corresponding first to fourth lamps 321, 322, 323 and 324 connected to the balance transformer unit 330 are constant.

In this exemplary embodiment, magnetic fields are interlinked among the coils 332, 333, 334 and 335 wound at the same turns ratio on the single body 331, so that the same currents I1, I2, I3 and I4 can be distributed. As shown in FIG. 3, the first to fourth coils 332, 333, 334 and 335 share magnetic flux and keep current balance among them. That is, the magnetic flux flows from the left to the right in the central shaft on which the coils are wound but from the right to the left in upper and lower frames of the body 331, as designated by dotted arrows, so that the first to fourth coils 332, 333, 334 and 335 can share the magnetic flux. Accordingly, the adjacent respective coils act as a primary coil and a secondary coil of the transformer, making the currents I1, I2, I3 and I4 flowing between the coils constant. Here, since the turns ratios of the coils are identical with one another, an identical current flows among the first to fourth coils, and thus through the corresponding first to fourth lamps 321, 322, 323 and 324.

The first and second adjacent coils 332 and 333 become a primary coil and a secondary coil, respectively, having the same turns ratio, and a constant current flows therebetween, so that the currents I1 and I2 respectively flowing through the first lamp 321 and the second lamp 322 can be identical with each other. The second coil 333 and the third coil 334 become a primary coil and a secondary coil, respectively, having the same turns ratio, so that the currents I2 and I3 respectively flowing through the second lamp 322 and the third lamp 323 can be identical with each other. The third coil 334 and the fourth coil 335 become a primary coil and a secondary coil, respectively, having the same turns ratio, so that the currents I3 and I4 respectively flowing through the third lamp 323 and the fourth lamp 324 can be identical with each other. The fourth coil 335 and the first coil 332 become a primary coil and a secondary coil, respectively, having the same turns ratio, so that the currents I4 and I1 respectively flowing through the fourth lamp 324 and the first lamp 321 can be identical with each other. In this manner, the balance transformer unit 330 of this embodiment enables the currents I1, I2, I3 and I4 flowing through the first to fourth coils 332, 333, 334 and 335 to be uniform, so that the currents flowing through the first to fourth lamps 321, 322, 323 and 324 can be identical with one another. Accordingly, the luminance of the first to fourth lamps 321, 322, 323 and 324 can be maintained uniform.

Variants of the balance transformer unit 330 according to this exemplary embodiment will be described with reference to the accompanying drawings.

FIGS. 4 to 7 are views illustrating variants of the exemplary embodiment of the balance transformer unit 330 according to the present invention.

Figure 4:
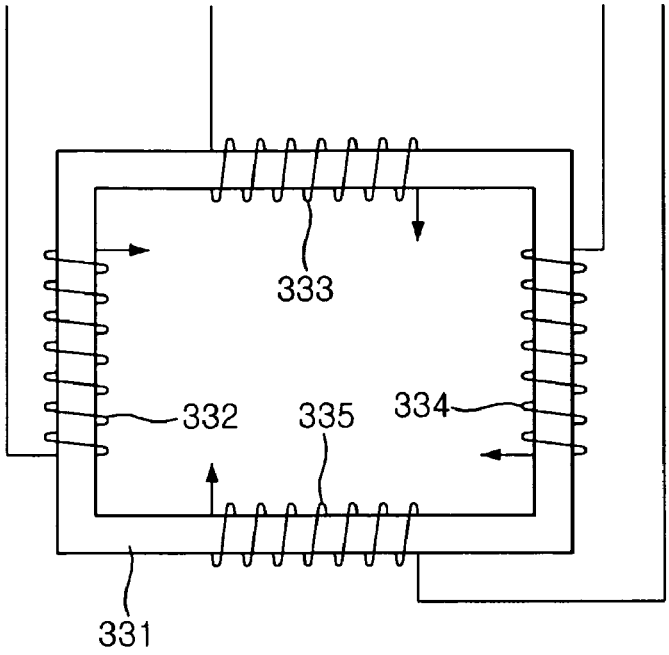
FIGS. 4 to 7 are views illustrating variants of exemplary embodiments of the balance transformer unit according to the present invention.

As shown in FIG. 4, a balance transformer unit 330 comprises a closed rectangular body 331, and first to fourth coils 332, 333, 334 and 335 each of which is wound on one side of four sides defining the body 331. Preferably, the body 331 is made of a conductive material and advantageously has a plurality of overlapping rectangular iron cores in this variant. Preferably, the first to fourth coils 332, 333, 334 and 335 wound on the body 331 to have the same turns ratio share respective magnetic flux. Preferably, the coils are wound on the body 331 multiple times in the same direction. Of course, the present invention is not limited thereto, and the body 331 may have a polygonal shape including a rectangular shape, for example.

Figure 5:
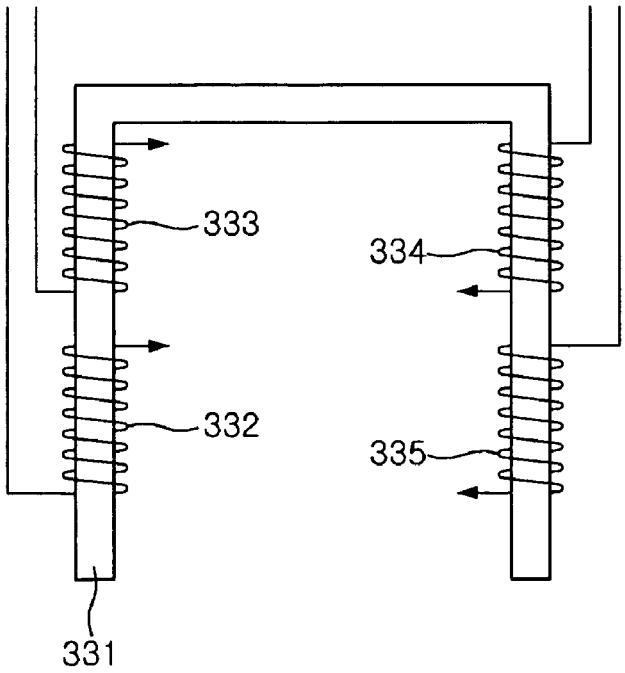

As shown in FIG. 5, a balance transformer unit 330 comprises a body 331 including first and second shafts, and a connection portion connecting the first and second shafts to each other; and first to fourth coils 332, 333, 334 and 335 wound on the first and second shafts of the body 331. Preferably, the first and second coils 332 and 333 are wound on the first shaft, and the third and fourth coils 334 and 335 are wound on the second shaft. Preferably, the coils wound on the same shaft have the same winding direction. Of course, the present invention is not limited thereto. Preferably, a plurality of shafts are provided and at least one coil is wound on each of the shafts.

Figure 6:
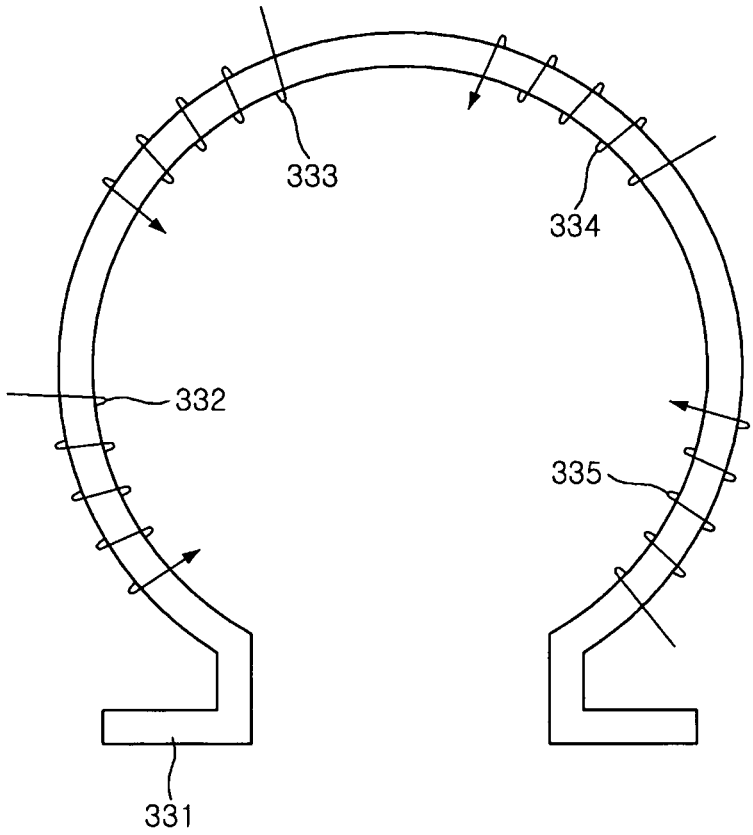

As shown in FIG. 6, a balance transformer unit 330 comprises a horseshoe-shaped body 331 (e.g., partially open circular shaped body), and first to fourth coils 332, 333, 334 and 335 wound on the body 331. Of course, the present invention is not limited thereto and the body 331 may have a circular or elliptical shape. Alternatively, the body 331 may have a partially opened circular or elliptical shape.

Figure 7:
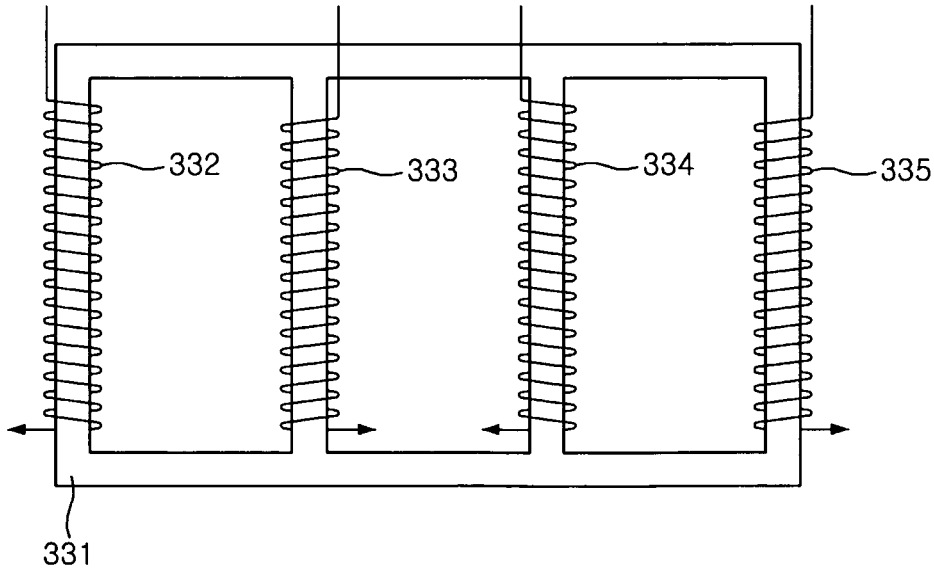

As shown in FIG. 7, a balance transformer unit 330 comprises a body 331 having first to fourth shafts and upper and lower connection portions connecting the first to fourth shafts to one another, and first to fourth coils 332, 333, 334 and 335 respectively wound on the first to fourth shafts. That is, the first coil 332 is wound on the first shaft, the second coil 333 on the second shaft, the third coil 334 on the third shaft and the fourth coil 334 on the fourth shaft. Preferably, the winding directions of adjacent coils are opposite to each other. In this variant, the plurality of coils 332, 333, 334 and 335 wound on the body 331 advantageously have the same turns ratio and share magnetic flux. That is, in this exemplary embodiment, the body 331 of the balance transformer unit 330 may have any shape that can allow the magnetic flux between the wound coils 332, 333, 334 and 335 to be interlinked. In addition, there is no limitation on the number of coils wound on the body.

While the balance transformer unit has been described as having the four coils wound on a single body, the present invention is not limited thereto. Preferably, at least two coils are wound on a single body. More preferably, three to five coils are wound on a single body in consideration of turns ratios of the coils wound on the body and manufacturing rigidity (e.g., a problem of extension of the length of the body, i.e., a core). Since the coils wound on the single body share magnetic flux in the balance transformer unit, the balance transformer unit serves as a current level adjuster for constantly maintaining a constant current flowing through the coils. This enables the currents flowing through the lamps connected to the coils to be constant, thereby making the luminance of the plurality of lamps uniform and reducing the size of the balance transformer unit. In addition, the number of coils to be used can be reduced.

In exemplary embodiments described herein, one balance transformer unit is used to enable a uniform current to flow through four lamps.

In the liquid crystal display according to these exemplary embodiments, the number of the lamps used in the lamp unit is not limited to four but more or less lamps may be used. Preferably, the number of the lamps is variously changed depending on the size of the liquid crystal display. Preferably, 14 to 18 lamps are used for a 32 inch liquid crystal display, 18 to 22 lamps may be used for a 40 inch liquid crystal display, and 22 to 26 lamps may be used for a 42 inch liquid crystal display. At this time, the lamps are advantageously arranged in parallel at equal intervals.

Another exemplary embodiment of the present invention in which a lamp unit can provide uniform luminance by causing a uniform current to flow through a number of lamps that uses a plurality of balance transformer units will be described below. Here, the same description as that of the aforementioned exemplary embodiment will be omitted in the following description.

Figure 8:
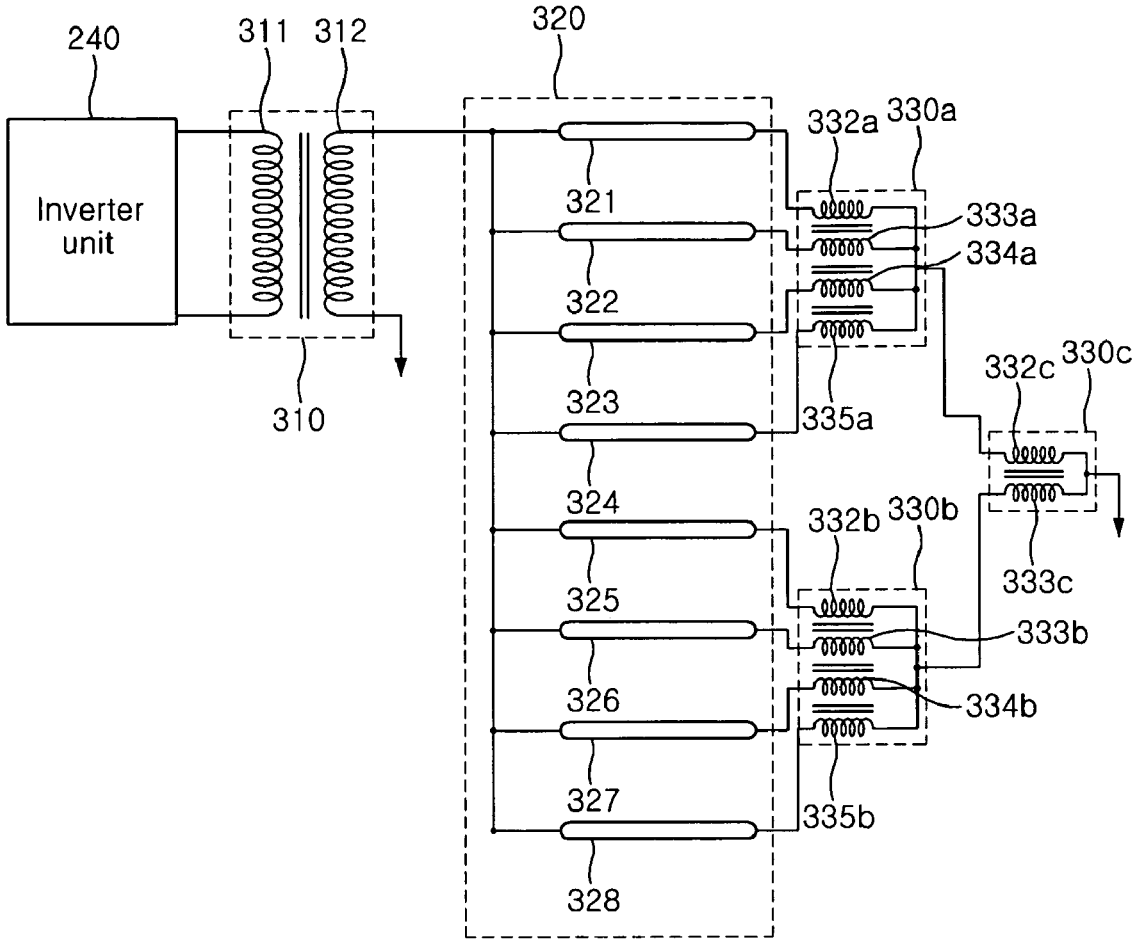
FIG. 8 is a circuit schematic diagram of another exemplary embodiment of a backlight unit according to the present invention.

FIG. 8 is a circuit schematic diagram of another exemplary embodiment of a backlight unit according to the present invention.

Referring to FIG. 8, a backlight unit 300 comprises a main transformer unit 310 for converting an AC power voltage supplied by an inverter unit 240 into a voltage with a corresponding amplitude, a lamp unit 320 operating with the voltage supplied by the voltage main transformer unit 310, and first to third balance transformer units 330*a*, 330*b* and 330*c* for uniformly maintaining the luminance of the lamp unit 320 by uniformly sustaining a current applied to each lamp of the plurality of lamps 321-328 of the lamp unit 320.

The main transformer unit 310 comprises a body a primary coil 311 and a secondary coil 312 both wound on the body. The primary coil 311 is connected to the inverter unit 240. The secondary coil 312 has one end connected to the lamp unit 320, and the other end connected to a ground.

The lamp unit 320 comprises first to eighth lamps 321, 322, 323, 324, 325, 326, 327 and 328, wherein two pairs of four lamps are connected in parallel between the main transformer unit 310 and the first and second balance transformer units 330*a* and 330*b*, respectively.

The first and second balance transformer units 330*a* and 330*b* comprise a first transformer with first to fourth coils 332*a*, 333*a*, 334*a* and 335*a* wound on a first single body and a second transformer with first to fourth coils 332*b*, 333*b*, 334*b* and 335*b* wound on a second single body, respectively. The third balance transformer unit 330*c* comprises a third transformer with first and second coils 332*c* and 333*c* wound on a third single body.

In the first balance transformer unit 330*a*, each of the first to fourth coils 332*a*, 333*a*, 334*a*, and 335*a* has one end connected to a corresponding one of the first to fourth lamps 321, 322, 323 and 324, and the other end connected to one end of the first coil 332*c* of the third balance transformer unit 330*c*. In the second balance transformer unit 330*b*, each of the first to fourth coils 332*b*, 333*b*, 334*b* and 335*b* has one end connected to a corresponding one of the fifth to eighth lamps 325, 326, 327 and 328, and the other end connected to one end of the second coil 333*c* of the third balance transformer unit 330*c*. In the third balance transformer unit 330*c*, the other end of each of the first and second coils 332*c* and 333*c* is connected to a ground.

Preferably, the coils of the aforementioned first to third balance transformer units 330*a*, 330*b* and 330*c* have the same turns ratio. In the balance transformer units 330*a*, 330*b* and 330*c*, the coils share magnetic flux, and one of two adjacent coils becomes a primary coil and the other becomes a secondary coil, so that constant currents can flow through the coils. In addition, in the third balance transformer unit 330*c*, the first and second coils 332*c* and 333*c* serves as a primary coil and a secondary coil, respectively, of the transformer. In this case, since the two coils have the same turns ratio as described above, currents flowing through the two coils are identical with each other. While four lamps are additionally provided in the present exemplary embodiment of FIG. 8 contrary to the aforementioned exemplary embodiment of FIG. 2, only two balance transformer units are added, thereby reducing the number of balance transformer units to be used.

According to the principle of the exemplary embodiment of FIG. 8 described above, currents flowing through a theoretically infinite number of lamps can be balanced, and the numbers of coils and transformer units can be significantly reduced. In addition, even when every lamp is needed to be driven in an inverse phase, lamps may be arranged in an interleave fashion in the same manner as the eight lamps in the present exemplary embodiment.

Figure 9:
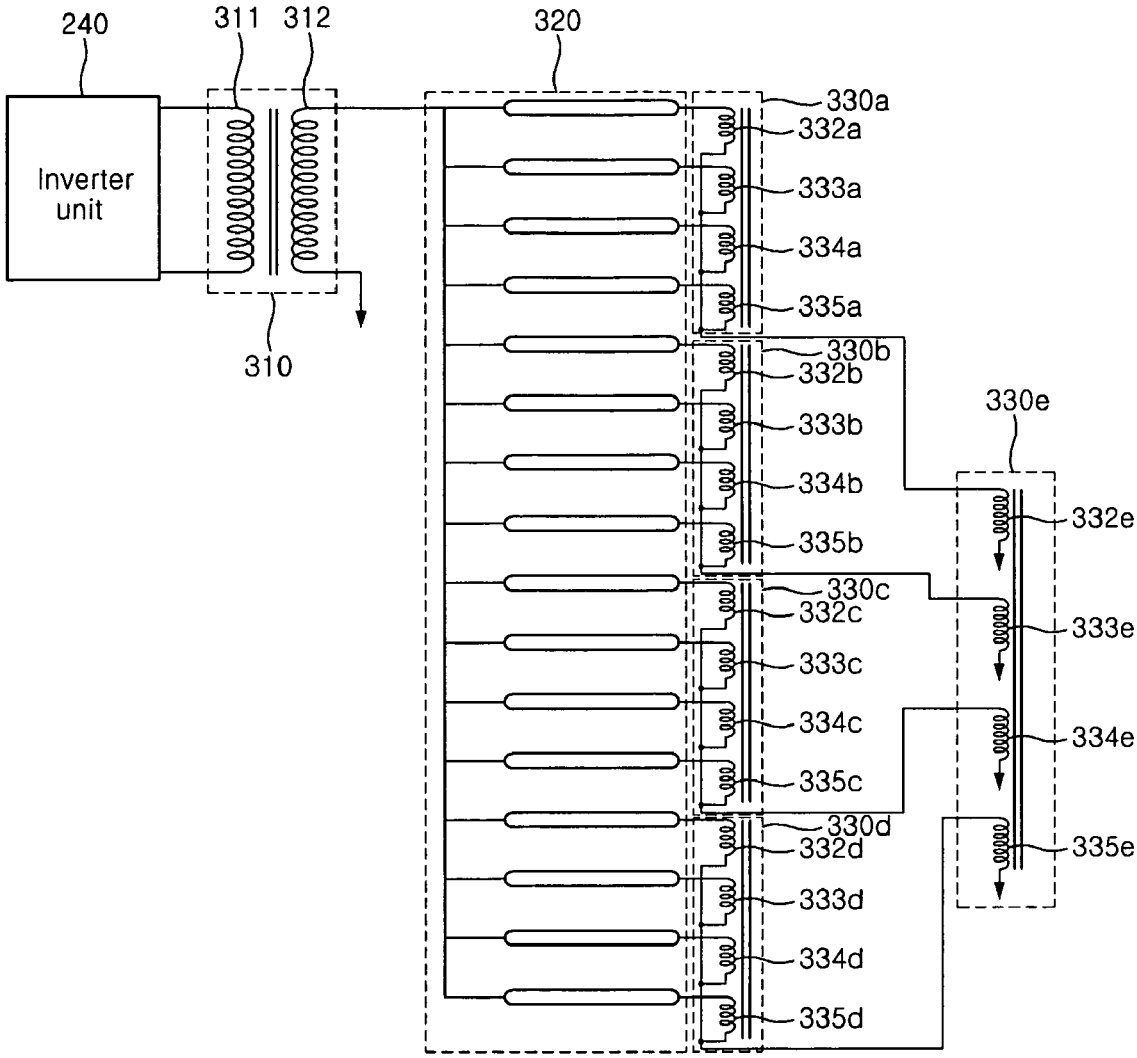
FIG. 9 is a circuit schematic diagram of another exemplary embodiment of a backlight unit illustrating a first variant of the backlight unit of FIG. 8 according to the present invention.

FIG. 9 is a circuit schematic diagram of another exemplary embodiment of a backlight unit according to a first variant of the exemplary embodiment of FIG. 8.

In FIG. 9, five balance transformer units 330*a*, 330*b*, 330*c*, 330*d* and 330*e* are used to apply a uniform current to sixteen lamps. That is, the first to fifth balance transformer units 330*a*, 330*b*, 330*c*, 330*d* and 330*e* include transformers with first to fourth coils 332*a* to 332*e*, 333*a* to 333*e*, 334*a* to 334*e* and 335*a* to 335*e* wound on respective bodies of the balance transformer units. In the first to fourth balance transformer units 330*a*, 330*b*, 330*c* and 330*d*, each of the first to fourth coils 332*a* to 332*d*, 333*a* to 333*d*, 334*a* to 334*d* and 335*a* to 335*d* has one end connected to the four lamps, and the other end connected to one of the first to fourth coils 332*e*, 333*e*, 334*e* and 335*e* of the fifth balance transformer unit 330*e*. In the fifth balance transformer unit 330*e*, the other end of each of the first to fourth coil 332*e*, 333*e*, 334*e*, 335*e* is connected to a ground. This enables a current flowing through all of the sixteen lamps to be uniformly maintained.

While the number of the lamps in the exemplary embodiment of FIG. 9 increases by eight, only two additional balance transformer units are added compared to the exemplary embodiment of FIG. 8 having three balance transformer units. Thus, there are remarkable advantages in that costs are reduced and a space is efficiently used. In addition, it can be seen while twelve lamps are added compared to the exemplary embodiment of FIG. 2, only four balance transformer units are added.

Figure 10:
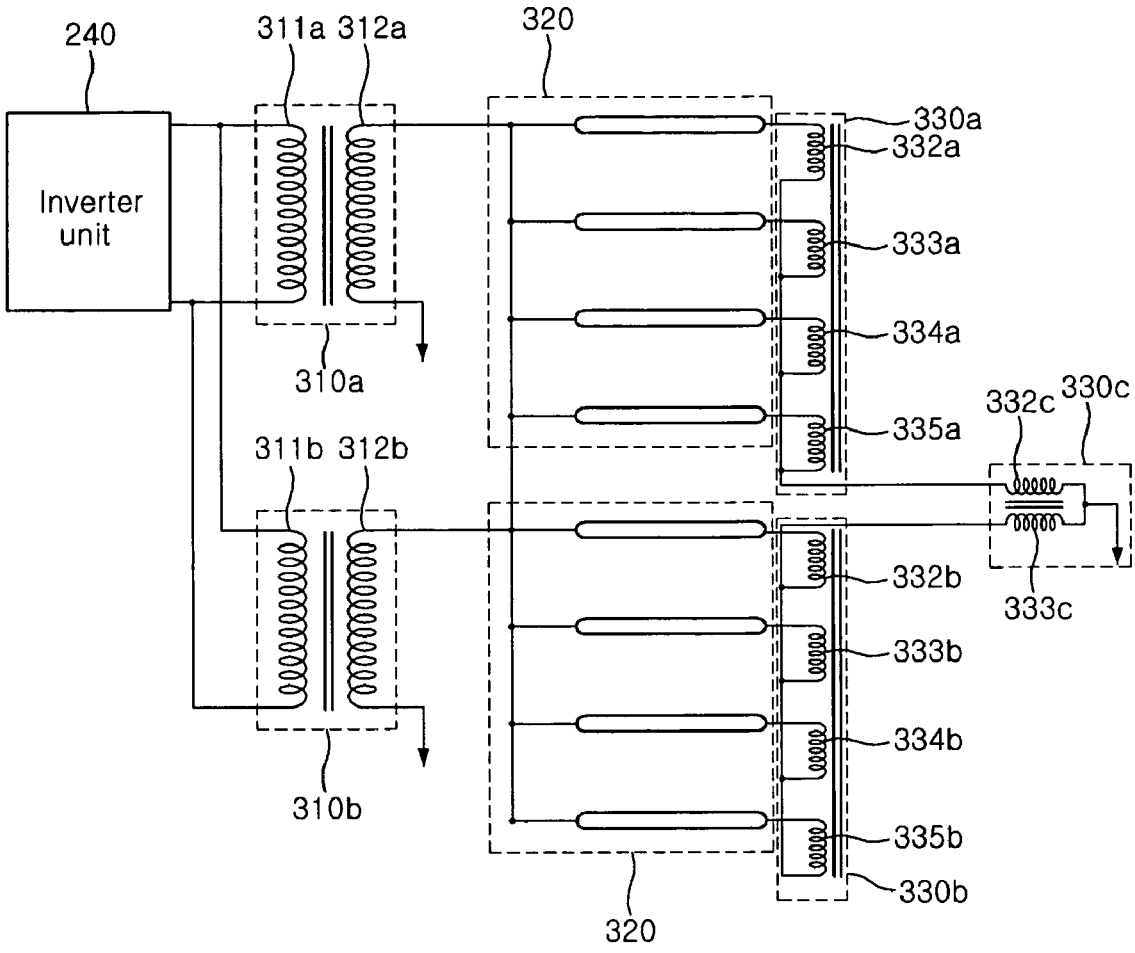
FIG. 10 is a circuit schematic diagram of another exemplary embodiment of a backlight unit illustrating a second variant of the backlight unit of FIG. 8 according to the present invention.

FIG. 10 is a circuit schematic diagram of another exemplary embodiment of a backlight unit according to a second variant of the exemplary embodiment of FIG. 8.

As shown in FIG. 10, a backlight unit 300 according to this variant comprises first and second main transformer units 310*a* and 310*b* for converting an AC power voltage supplied by the inverter unit 240 to a voltage with a corresponding amplitude. Each of the first and second main transformer units 310*a* and 310*b* supplies the voltage to a corresponding four lamps of eight lamps of the lamp unit 320. The first and second main transformer units 310*a* and 310*b* comprise primary coils 311*a* and 311*b* and secondary coils 312*a* and 312*b*, respectively. Each of the primary coils 311*a* and 311*b* has both ends connected to the inverter unit 240. Each of the secondary coils 312*a* and 312*b* of the first and second main transformer units 310*a* and 310*b* has one end connected to one set of four lamps and the other end connected to a ground.

While the two main transformer units 310*a* and 310*b* used respectively to drive the different pairs of four lamps have been described in connection with this variant, the present invention is not limited thereto and the number of the lamps driven by one main transformer unit may be variously changed depending on the capacity of the main transformer unit. That is, eight lamps may be driven by one main transformer unit as in the exemplary embodiment of FIG. 8 or by the two main transformer units as in FIG. 10.

Figure 11:
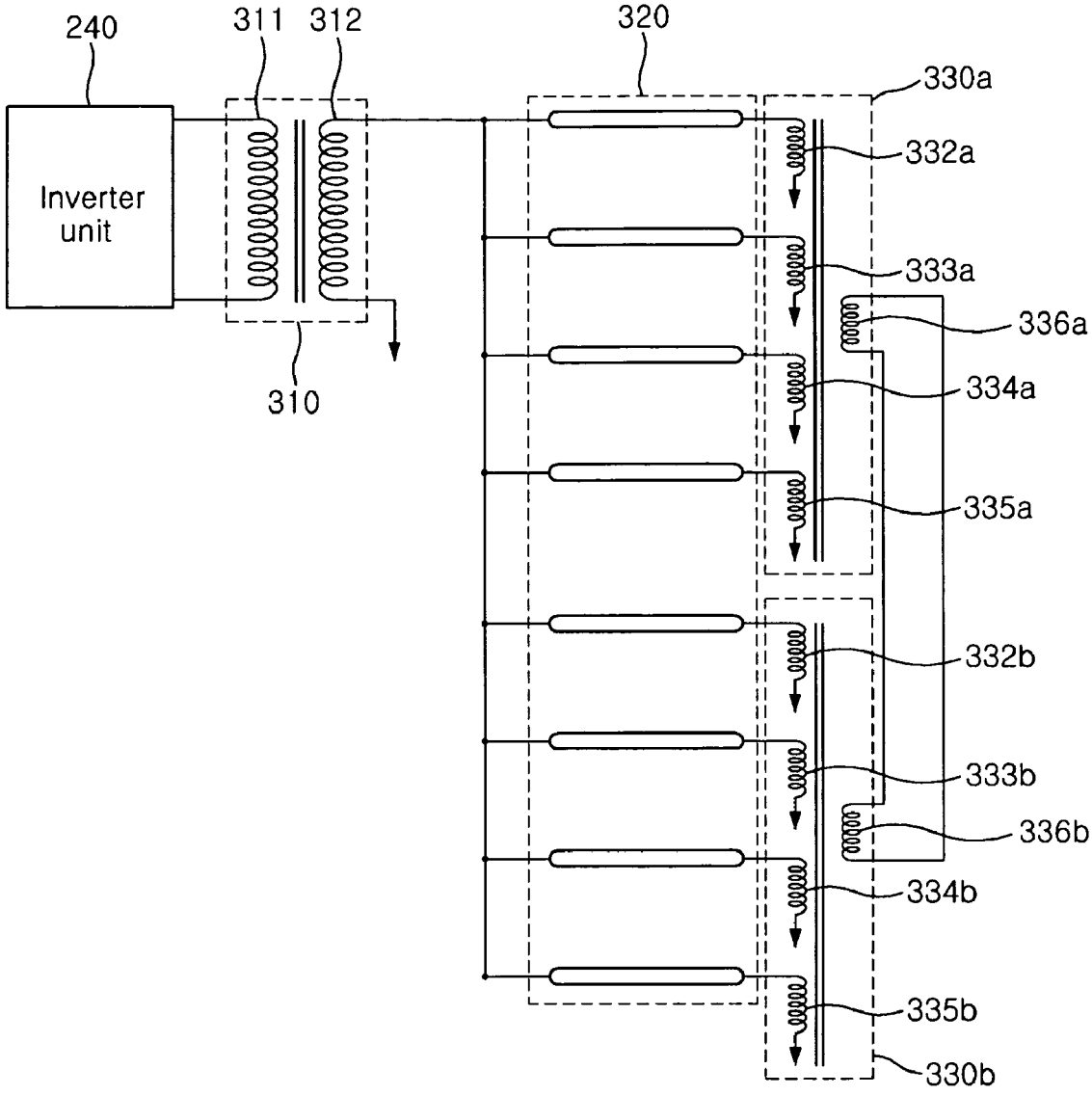
FIG. 11 is a circuit schematic diagram of yet another exemplary embodiment of a backlight unit illustrating a third variant of the backlight unit of FIG. 8 according to the present invention.

FIG. 11 is a circuit schematic diagram of yet another exemplary embodiment of a backlight unit according to a third variant of the exemplary embodiment of FIG. 8.

As shown in FIG. 11, a backlight unit according to this variant comprises a main transformer unit 310, a lamp unit 320 including a plurality of lamps (e.g., eight lamps), and first and second balance transformer units 330*a* and 330*b* connected to the lamps of the lamp unit 320 for uniformly maintaining a current through the lamps.

The first and second balance transformer units 330*a* and 330*b* comprise first to fifth coils 332*a*, 333*a*, 334*a*, 335*a* and 336*a* wound on a first single body and first to fifth coils 332*b*, 333*b*, 334*b*, 335*b* and 336*b* wound on a second single body, respectively. In the first balance transformer unit 330*a*, each of the first to fourth coils 332*a*, 333*a*, 334*a* and 335*a* has one end connected to a corresponding lamp in the lamp unit 320, and the other end connected to a ground, and the fifth coil 336*a* has both ends connected to the fifth coil 336*b* of the second balance transformer unit 330*b*. In the second balance transformer unit 330*b*, each of the first to fourth coils 332*b*, 333*b*, 334*b* and 335*b* has one end connected to a corresponding lamp, and the other end connected to a ground. In the first and second balance transformer units 330*a* and 330*b*, all of the coils have the same turns ratio, and accordingly, currents flowing through the coils of the balance transformer units are identical with each other. Since the fifth coils 336*a* of the first balance transformer unit 330*a* is electrically connected to the fifth coil 336*b* of the second balance transformer unit 330*b*, constant currents flow through the fifth coils 336*a* and 336*b*. In this manner, the currents flowing through the coils in the first and second balance transformer units 330*a* and 330*b* can also become constant. This is because, when a primary coil and a secondary coil of a transformer have the same turns ratio, currents flowing through the two coils are identical with each other, as described above. That is, the fifth coil 336*a* and 336*b* of each of the balance transformer units 330*a* and 330*b* becomes the secondary coil to keep the current balance in the first to fourth coils as the primary coil.

As described above, in this exemplary embodiment, the lamp currents of the plurality of lamps can be maintained uniformly by using the pair of balance transformer units each including a plurality of coils in which magnetic flux is interlinked. Thus, luminance between the lamps can be maintained uniformly. In addition, the pair of balance transformer units is used to uniformly maintain the lamp currents of the plurality of lamps uniform, thereby reducing costs and an occupying area of the balance transformer unit.

As described above, according to the present invention, a balance transformer unit capable of uniformly maintaining a lamp current is provided to respective ends of a plurality of lamps, so that a uniform lamp current can be applied to each of the lamps. Thus, luminance can be maintained uniformly among the lamps.

In addition, a balance transformer unit with a plurality of coils wound on a single body is provided, so that a uniform current can be induced to each of the coils through interlinkage of magnetic flux.

In addition, lamp currents of a plurality of lamps are maintained uniformly with a reduced number of coils and balance transformers units to be used, thereby reducing costs and an occupying area of a balance transformer unit.

While the present invention has been illustrated and described in connection with the accompanying drawings and the exemplary embodiments, the present invention is not limited thereto and is defined by the appended claims. Therefore, it will be understood by those skilled in the art that various modifications and changes can be made thereto without departing from the spirit and scope of the invention defined by the appended claims.

What is claimed is:

1. An apparatus for driving lamps, comprising:

a main transformer unit for supplying a driving voltage to a plurality of lamps;

first and second balance transformer units connected to the plurality of lamps, the first and second balance transformer units providing a same uniform lamp current to each of the lamps, wherein each of the first and second balance transformer units comprises:

a plurality of primary coils, secondary coils, and a body, wherein at least two primary coils and a secondary coil wound on a single body, and each of the primary coils have one end connected to a corresponding lamp in the lamp unit, and the other end connected to ground, wherein the secondary coils uniformly maintain lamp currents between first and second balance transformer unit.

2. The apparatus as claimed in claim 1, wherein each of the plurality of coils of one of the at least two second transformer units comprises a first end connected to a respective one end of each of some of the lamps and a second end connected to a first end of one of the coils in the third transformer unit, each of the plurality of coils of the other of the at least two second transformer units comprises a first end connected to a respective one end of each of the other of the lamps and a second end connected to a first end of the other coil in the third transformer unit, and seconds ends of the coils of the third transformer unit are connected to a ground.

3. The apparatus as claimed in claim 1, wherein one coil of one of the second transformer units is electrically connected to one coil of the other of the second transformer units.

4. The apparatus as claimed in claim 1, wherein the plurality of coils of the second transformer unit share magnetic flux.

5. The apparatus as claimed in claim 1, wherein the plurality of coils have the same turns ratio.

6. The apparatus as claimed in claim 1, wherein the number of the coils is three to five.

7. The apparatus as claimed in claim 1, wherein the body is made of a conductive material.

8. The apparatus as claimed in claim 7, wherein the plurality of coils are wound on the body in the same direction, or at least some of the coils are wound on the body in a different direction.

9. The apparatus as claimed in claim 1, wherein the first transformer unit comprises a transformer including a primary coil and a secondary coil, the primary coil is connected to an input power source, and the secondary coil has one end connected to each of the lamps and the other end connected to a ground.

10. The apparatus as claimed in claim 1, wherein the body has a shape including one of a polygonal shape, a circular shape, an elliptical shape, a horseshoe shape, a rod shape, and a shape having one or more rods with coils wound thereon and at least one connection portion for connecting the rods to each other.

11. An apparatus for driving lamps, comprising:

a main transformer unit for supplying a driving voltage to a plurality of lamps;

at least two first balance transformer units connected to the plurality of lamps, the at least two first balance transformer units providing a same uniform lamp current to each of the lamps, wherein each of the at least two first balance transformer units comprises:

a first body, and a plurality of coils wound on the first body; and a second balance transformer unit for uniformly maintaining a current between at least two first balance transformer units, the second balance transformer unit comprises:

a second body, and at least two coils wound on a second body, wherein the main transformer unit comprises a first and second main transformer unit, each of which includes a primary coil and a secondary coil, the primary coil of each of the first and second main transformer units connected to an input power source, and the secondary coil of the first and second main transformer unit connected to the plurality of lamps, wherein the secondary coil of the first main transformer unit and the secondary coil of the second main transformer unit disconnect to the same lamp.

12. A liquid crystal display, comprising:

a backlight unit for emitting light; and a liquid crystal display panel for displaying an image by means of the light, wherein the backlight unit comprises:

a lamp unit including a plurality of lamps;

a main transformer unit for converting an input AC voltage and applying the converted voltage to the plurality of lamps;

first and second balance transformer units each having a plurality of first coils wound on a single body so as to make a lamp current of each of the plurality of lamps uniform; and a second coil wound on the single body, wherein each of the of the plurality of first coils connects to each of the plurality of lamps and the second coil of the first balance transformer unit connects to the second coil of the second balance transformer unit.

13. The liquid crystal display as claimed in claim 12, further comprising:

a rectifying unit for converting a general-purpose AC voltage to a DC voltage;

a voltage converting unit for converting the level of the DC voltage supplied by the rectifying unit and applying the converted voltage to the liquid crystal display panel; and an inverter unit for converting the DC voltage supplied by the rectifying unit into an AC voltage and supplying the AC voltage to the first transformer unit.

14. The liquid crystal display as claimed in claim 12, wherein the plurality of coils of the second transformer unit share magnetic flux.

15. The liquid crystal display as claimed in claim 12, wherein the plurality of coils of the second transformer unit share have the same turns ratio.

16. The liquid crystal display as claimed in claim 12, wherein the body is made of a conductive material.

17. The liquid crystal display as claimed in claim 12, wherein each of the plurality of coils in the second transformer unit has one end connected to one end of each of the lamps, and the other end connected to a ground.

18. The liquid crystal display as claimed in claim 12, wherein each of the plurality of coils of one of the at least two second transformer units comprises a first end connected to a respective one end of each of some of the lamps and a second end connected to a first end of one of the coils in the third transformer unit, each of the plurality of coils of the other of the at least two second transformer units comprises a first end connected to a respective one end of each of the other of the lamps and a second end connected to a first end of the other coil in the third transformer unit, and seconds ends of the coils of the third transformer unit are connected to a ground.

19. The liquid crystal display as claimed in claim 12, wherein one coil of one of the second transformer units is electrically connected to one coil of the other of the second transformer units.

20. The liquid crystal display as claimed in claim 12, wherein the first transformer unit comprises a transformer including a primary coil and a secondary coil, the primary coil is connected to an input power source, and the secondary coil has one end connected to each of the lamps and the other end connected to a ground.

21. The apparatus as claimed in claim 12, wherein the body has a shape including one of a polygonal shape, a circular shape, an elliptical shape, a horseshoe shape, a rod shape, and a shape having one or more rods with coils wound thereon and at least one connection portion for connecting the rods to each other.

22. An apparatus for driving lamps, comprising:

a main transformer unit for supplying a driving voltage to a plurality of lamps;

at least two first balance transformer units connected to the plurality of lamps, the at least two first balance transformer units providing a same uniform lamp current to each of the lamps, wherein the two first balance transformer units comprises:

a first body, and a plurality of coils wound on the first body; and a second balance transformer unit for uniformly maintaining a current between at least two first balance transformer units, second balance transformer unit comprising at least two coils wound on a second body, wherein the main transformer unit comprises first and second main transformer units each of which includes a primary coil and a secondary coil, the primary coil of each of the first and second main transformer units connected to an input power source, and the secondary coil of the first and second main transformer units connected to the plurality of lamps.

* * * * *